US006978564B2

(12) United States Patent
Hou

(10) Patent No.: US 6,978,564 B2
(45) Date of Patent: Dec. 27, 2005

(54) DECORATIVE DISPLAY

(76) Inventor: Jack Hou, 1002 Walker Rd., Great Falls, VA (US) 22066

( * ) Notice: Subject to any disclaimer, the term of this patent is extended or adjusted under 35 U.S.C. 154(b) by 0 days.

(21) Appl. No.: 10/645,634

(22) Filed: Aug. 22, 2003

(65) Prior Publication Data

US 2005/0039359 A1 Feb. 24, 2005

(51) Int. Cl.[7] ..... B09F 19/00
(52) U.S. Cl. ..... 40/406; 40/410; 40/426
(58) Field of Search ..... 40/409, 410, 426

(56) References Cited

U.S. PATENT DOCUMENTS

| | | | | |
|---|---|---|---|---|
| 4,852,283 | A | 8/1989 | Teng | |
| 4,890,828 | A | 1/1990 | Hou | |
| 4,961,276 | A | 10/1990 | Lin | |
| 4,987,787 | A | 1/1991 | Hou | |
| 5,018,288 | A | 5/1991 | Yang | |
| 5,070,633 | A | 12/1991 | Liu | |
| 5,090,144 | A | 2/1992 | Liu | |
| 5,110,636 | A | 5/1992 | Hou | |
| 5,131,175 | A | 7/1992 | Liu | |
| 5,203,743 | A | 4/1993 | Hou | |
| 5,456,031 | A | 10/1995 | Hou | |
| 5,864,976 | A | 2/1999 | Yang | |
| 6,241,255 | B1 | 6/2001 | Fang | |
| 6,508,022 | B2 * | 1/2003 | Huang | 40/426 |
| 6,523,287 | B1 * | 2/2003 | Lee | 40/410 |
| 6,568,107 | B2 * | 5/2003 | Yuen | 40/406 |

* cited by examiner

*Primary Examiner*—Andrew D. Wright

(57) ABSTRACT

A decorative display which has mainly a support base, a decorative base, a stopper, a transparent housing, a power source, at least a first magnet, and at least a second magnet, in which the stopper without a central hole is provided. Furthermore, at least a first magnet is provided under the stopper and at least a second magnet is provided over the stopper.

6 Claims, 16 Drawing Sheets

DECORATIVE DISPLAY

FIELD OF THE INVENTION

This invention relates to a decorative display, in particular to a decorative display having improved structures.

BACKGROUND OF THE INVENTION

There are several U.S. Pat. Nos. i.e., 4,987,787; 5,456,031; 5,110,636; 5,203,743; and 4,890,828, invented by the same inventor of the present invention. These patents relate to either a decorative display having mainly a transparent housing, and a music box ('031 and '636); or a carousel assembly ('787, '743, and '828).

Fang's U.S. Pat. No. 6,241,255 illustrates a decorative display having mainly a transparent housing, a music box (power source), and a transmission mechanism. A cylindrical magnet 42, two magnets 35, a water-sealing packing member 1, (FIG. 1), and other elements are provided. The disadvantage of this patent is that the water-sealing packing member 1 has a center through hole 12 in the central portion thereof. Water may leak downwardly through a gap or gaps which may be formed between the holder 2 and a rotary barrel 3 because of the uneven expansion due to high temperature of the member 1, and the rotary barrel 3, or because of the uneven shrinkage due to low temperature of the member 1, and the rotary barrel 3.

Lin's U.S. Pat. No. 4,961,276 also illustrates a decorative display having mainly a transparent housing, a power source, and a transmission mechanism. A first magnet 502, a second magnet 503, an upper plate 101 (FIG. 2), and other elements are provided. Again, the disadvantage of this patent is that the upper plate 101 (equivalent to the water-sealing package member 1 is '255) also has a central hole 102 in the central portion thereof. Water may leak downwardly through a gap or gaps which may be formed between the upper plate 101 and a housing 504, because of the uneven expansion due to high temperature of the upper plate 101, and the housing 504, or because of uneven shrinking due to low temperature of the upper plate 101, and the housing 504.

Teng's U.S. Pat. No. 4,852,283 also illustrates a decorative display having mainly a transparent housing, a power source, and a transmission mechanism. A plurality of magnets 46, a partition plate 40, a packing 3 (FIG. 1), and other elements are provided. Again, the advantage of this patent is that the water sealing packing member is formed of the partition plate 40 and the packing 3. Water may leak downwardly through a gap or gaps which may be formed between the partition plate 40 and the packing 3 because of the uneven expansion due to high temperature or the uneven shrinking due to low temperature of the partition plate 40 and the packing 3.

Yang's U.S. Pat. No. 5,864,976; Liu's U.S. Pat. Nos. 5,131,175, 5,090,144, and 5,070,633; and Yang's U.S. Pat. No. 5,018,288, depict other examples of a decorative display having mainly a housing, a power source, and a transmission mechanism.

SUMMARY OF THE INVENTION

An object of the present invention is to provide a decorative display which has mainly a support base, a decorative base member, a stopper member, a transparent housing, a power source, at least a first magnet, and at least a second magnet.

Another object of the present invention is to provide a decorative display in which a stopper member (equivalent to the water-sealing package member in the cited prior art) without a central hole is provided. Furthermore, at least a first magnet is provided under the stopper member and at least a second magnet is provided over the stopper member.

A further object of the present invention is to provide a decorative display which has many different embodiments of subassemblies which can be installed in the transparent housing.

Other objects and features of the present invention will become apparent from the following detailed description of the preferred embodiments thereof, when taken in conjunction with the drawings wherein like reference numerals refer to corresponding parts in the several views.

DETAILED DESCRIPTION OF THE PREFERRED EMBODIMENTS

Figure 1:
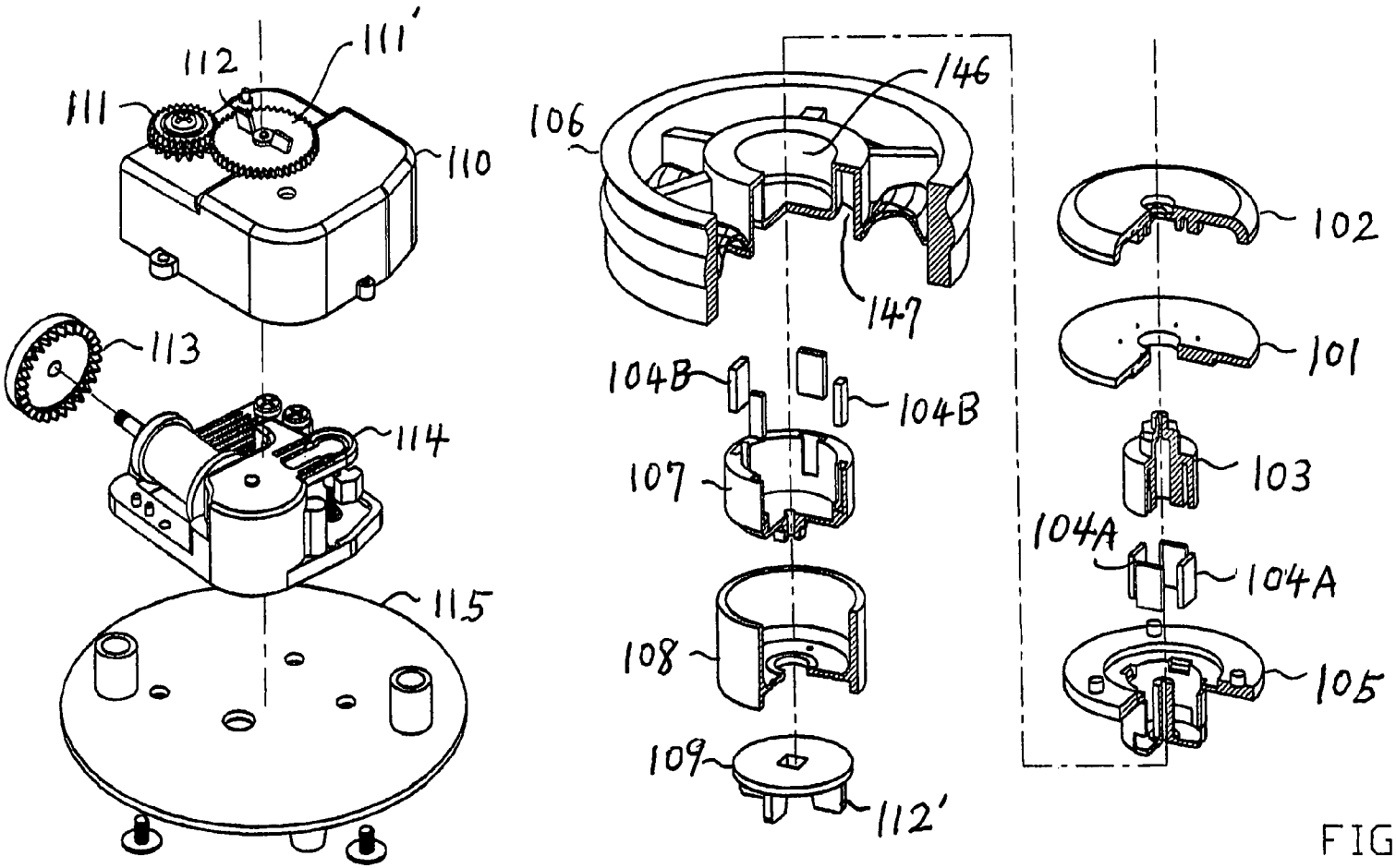
FIG. 1 is an exploded perspective view showing a main portion of a first embodiment of the present invention.

In the drawings, each of the elements in each drawing are not drawn to a same scale.

Figure 2:
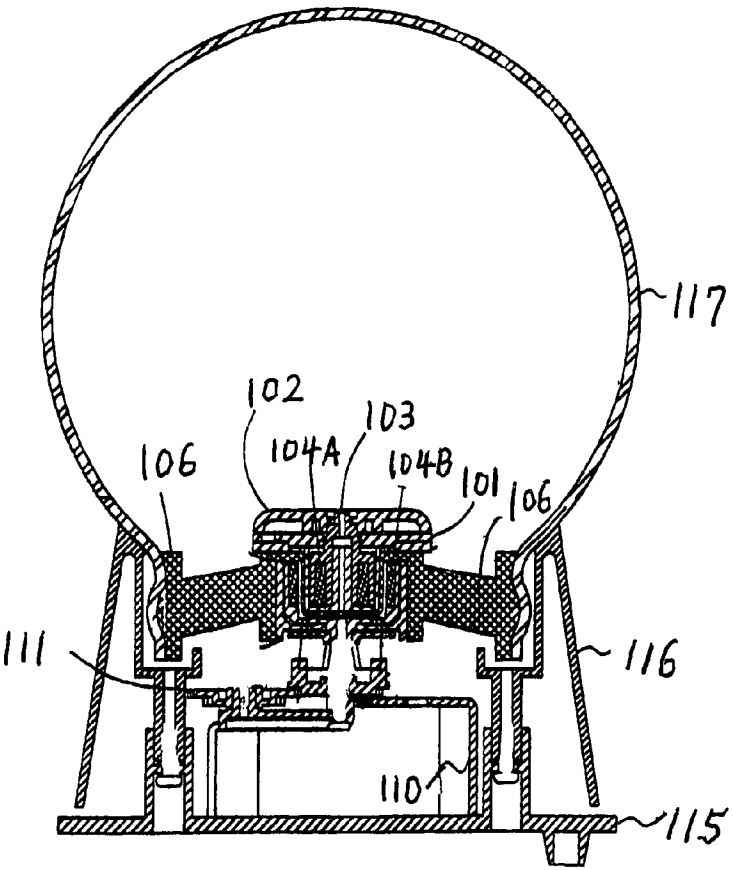
FIG. 2 is a cross-sectional view showing the first embodiment shown in FIG. 1 in an assembled position.

A first embodiment of the decorative display according to the present invention is illustrated in FIGS. 1 and 2. As can be seen, the decorative display comprises mainly a support base 115, a decorative base member 116, a stopper member 106 (which is equivalent to a water-sealing packing member in the cited prior art), a transparent housing 117, a music box (or a power source) 114, at least a first magnet 104A, and at least a second magnet 104B. The decorative base member 116 is installed on the support base 115. The transparent housing 117 is installed on the decorative base member 116. The stopper member 106 is installed in the lower portion of the transparent housing 117 and forms a sealing relationship therewith. The first magnets 104A and the second magnets 104B are for transmitting a movement from the music box (or power source) 114 from under the stopper member 106 to over the stopper member so that at least one figurine or subassembly 130 (FIG. 3) can be moved. A first rotary member 103, a second rotary member 107, a connecting member 105, and a lid 101 can further be provided. The first magnets 104A are installed in the first rotary member 103, the second magnets 104B are installed in the second rotary member 107, the connecting member 105 is fastened to the stopper member 106 and is provided for rotatably accommodating the first rotary member 103, the lid 101 is installed on the connecting member 105 for preventing the first rotary member 103 from falling off and for installing a figurine or a subassembly (e.g., 130 shown in FIG. 3) thereon. The stopper member 106 can be provided with a first recessed portion 146 for accommodating the first rotary member 103 and the connecting member 105, and a second recessed portion 147 for accommodating the second rotary member 107. The music box 114 can be installed on the support base 115 and can be a power source of other kinds, e.g., a motor not shown in the drawings.

A gear 113 can be installed on a rotating shaft of the music box 114 and can transmit the movement of the music box 114 through two gears 111 and 111', a rotary coupler 112 installed on the gear 111', another rotary coupler 112', a rotary piece 109, to the second rotary member 107. Numeral 110 designates a housing for the music box 114. The second rotary member 107 is fastened to the rotary piece 109 so as to rotate therewith. A socket member 108 which can be fastened to the stopper member 106 is for accommodating the second rotary member 107 so as to confine or stabilize the movement of the second rotary member 107. Numeral 102 designates a support on which a figurine or a subassembly can be positioned. The figurine or the subassembly can also be positioned or installed on the lid 101. The second rotary member 107 can be fastened directly on the gear 111' and the rotary couplers 112, and 112', and the rotary piece 109 can be omitted. Alternatively, other kinds of means, e.g., friction means, can be provided to transmit the movement from the gear 111' to the second rotary member 107. When the second rotary member 107 rotates, the first rotary member 103 rotates therewith because of the magnets 104B and 104A.

Figure 3:
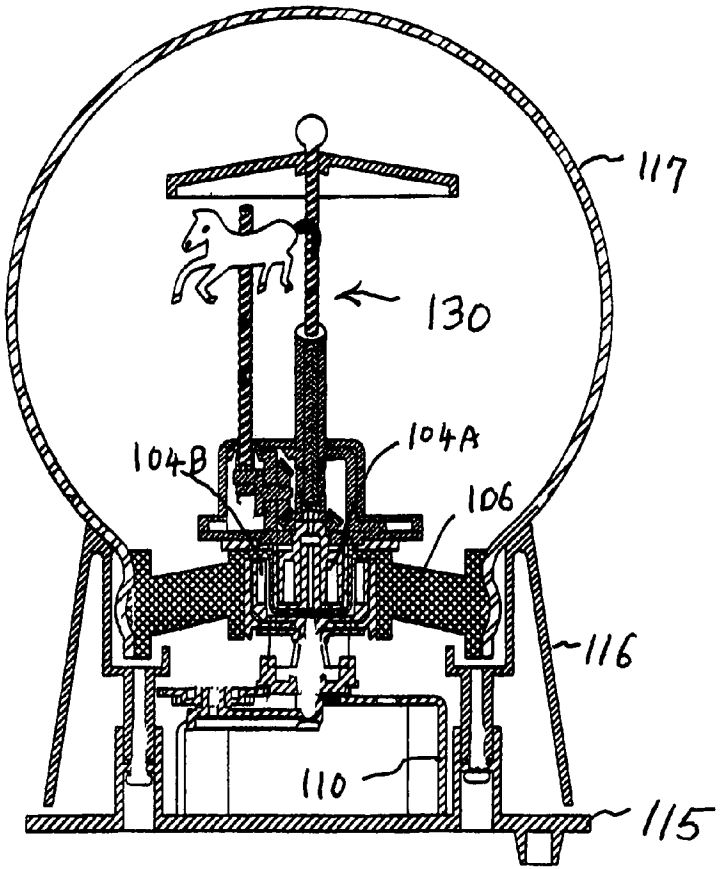
FIG. 3 is a cross-sectional view showing the first embodiment having schematic view of an embodiment of a subassembly installed in a transparent housing of the first embodiment of the present invention.

FIG. 3 depicts one example showing a subassembly 130 installed in the transparent housing 117. Many other embodiments of the subassemblies shown in FIGS. 8 through 19 can also be installed therein.

Figure 4:
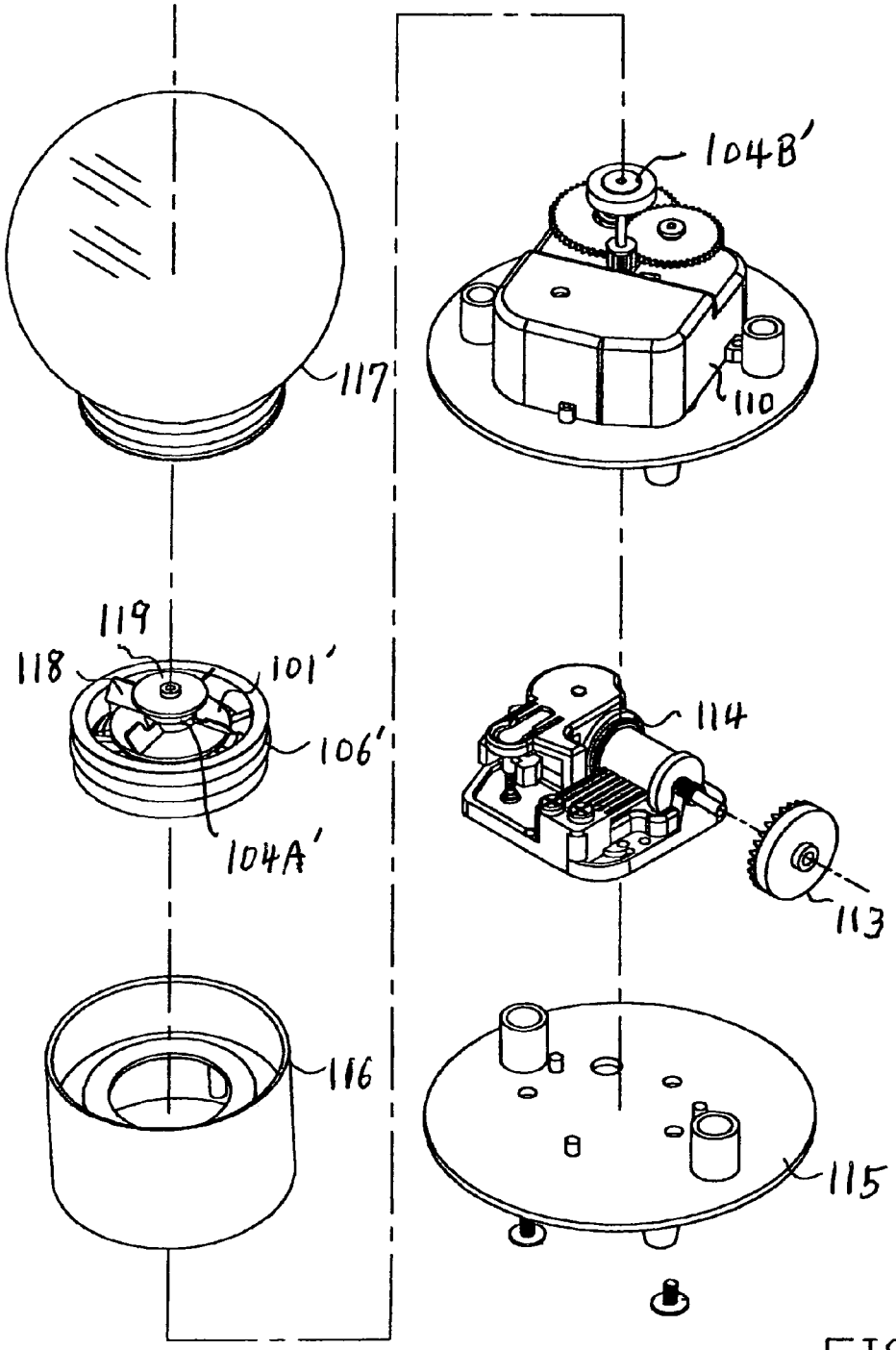
FIG. 4 is an exploded perspective view showing a second embodiment of the present invention.

FIG. 4 shows a second embodiment of the present invention. As can be seen, the decorative display comprises mainly a support base 115, a decorative base member 116, a stopper member 106' (this can be of same structure 106 shown in FIG. 1), a transparent housing 117, a music box 114, at least a first magnet 104A', and at least a second magnet 104B'. A gear 113 is connected to a shaft of the music box 114 for transmitting the movement of the music box 114 to the second magnet 104B'. At least one vane 118 can be fastened to the first magnet 104A' for agitating some particles in the transparent housing 117 so that it looks like some flurries are moved upwardly and falling down. A lid 101' similar to the lid in FIG. 1 is installed on the stopper member 106' for installing the vane 118 and the magnet 104A'. Another lid 119 is provided to prevent the vane 118 and the magnet 104A' from falling off. When the shaft of the music box 114 rotates, the gears, the magnets 104B', 104A', and the vanes 118 rotate to agitate the particles.

Figure 5:
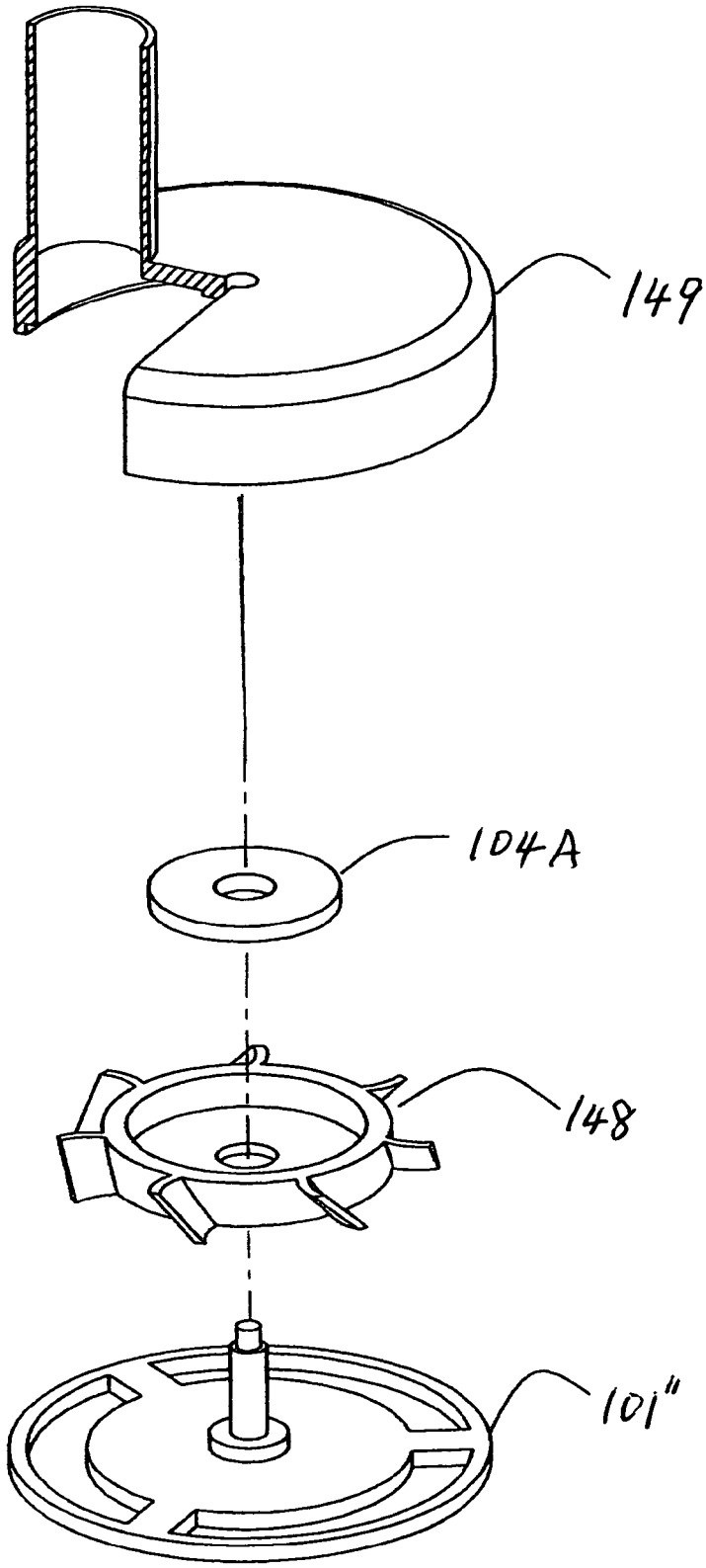
FIG. 5 is an exploded perspective view showing another embodiment of the subassembly shown on the left central portion of FIG. 4.

FIG. 5 shows another example of an agitating mechanism which was disclosed in FIG. 4 (left central portion). A lid 101" similar to the lid 101' (FIG. 4) can be provided. At least one opening can be formed on the lid 101". A rotary member 148 and a magnet 104A are positioned in the lid 101". A lid 149 covers the lid 101", the rotary member 148, and the magnet and has an opening so that the particles agitated by the rotary member 148 can exit.

Figure 7:
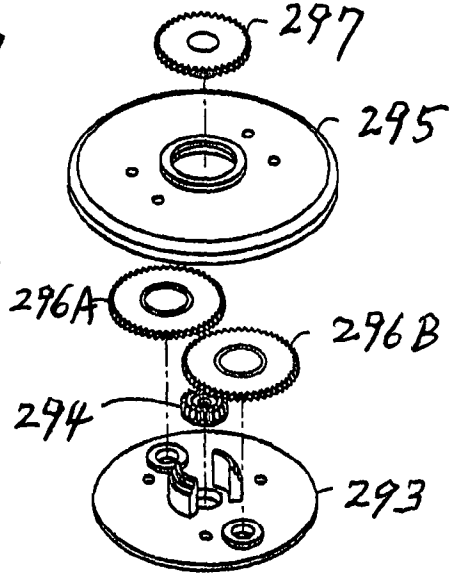
FIG. 7 is an exploded perspective view of a driving mechanism shown in FIG. 6.
Figure 6:
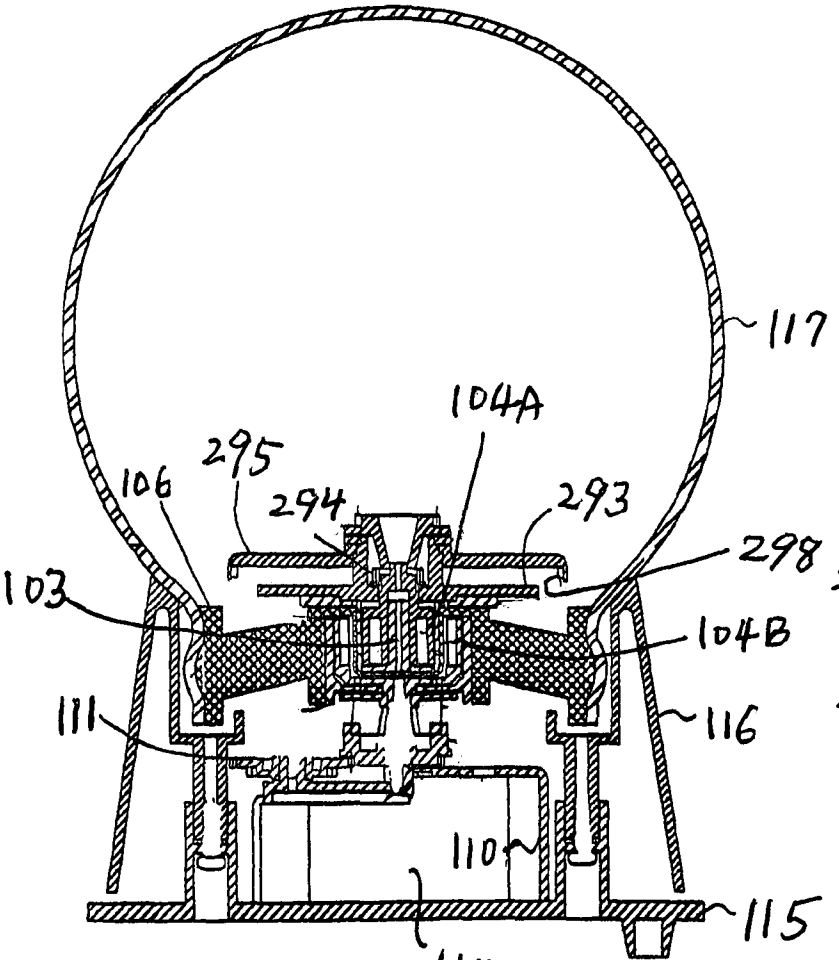
FIG. 6 is a cross-sectional view showing a third embodiment of the present invention.

FIGS. 6 and 7 show a third embodiment of the present invention, in which the decorative display comprises mainly a support base 115, a decorative base member 116, a stopper member 116, a transparent housing 117, a music box 114 (not shown clearly in the drawing), at least a first magnet 104A, and at least a second magnet 104B. A lid 293 (similar to the lid 101 shown in FIG. 1) is provided on top of the stopper member 116. The structure of the elements of this third embodiment of the present invention (FIG. 6) are basically the same as that shown in the first embodiment of the present invention (FIGS. 1 and 2). The structures of the third embodiment which are different from those of the first embodiment are to be described hereinbelow. A gear 294 is fastened to a rotary member 103 (the structure of the rotary member 103 is shown in detail in FIG. 1). Two gears 296A and 296A are located engageably with the gear 294. (The gears 296A and 296B are not shown in FIG. 6, but are shown in FIG. 7.) The teeth of the gears 296A and 296A engage teeth 298 (shown in FIG. 6) of a rotary cover 295. The teeth 298 of the rotary plate 295 are provided on the inside face of a vertical wall on the peripheral of the rotary cover 295. When the rotary member 103 rotates counterclockwisely, the gear 294 does the same, and the gears 296A and 296B, and the rotary cover 295 rotate clockwisely, and vice versa. A gear 297 can be fastened to the gear 294 or the rotary cover so as to drive other elements not shown in the drawings. We can also eliminate the gear 297 and have a figurine or decoration mounted on the rotary cover 295.

FIGS. 8, 9, 10, 11, 12, 13, 15, 16, 17, 18 and 19 show a first, second, third, fourth, fifth, sixth, seventh, eighth, ninth, tenth, and eleventh embodiments of a subassembly which can be installed in the transparent housing of the present invention shown in FIG. 2, 3, 4, or 6, or other driving mechanism.

Figure 8:
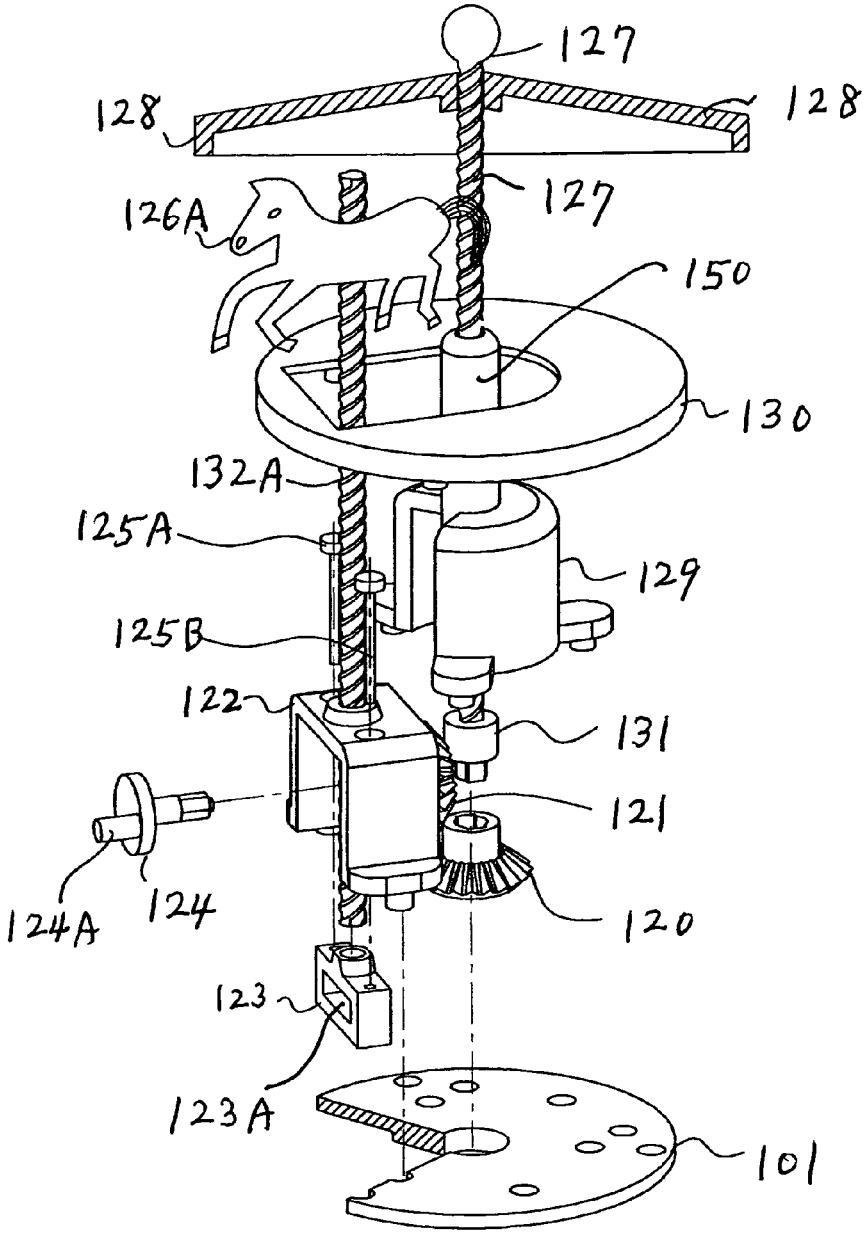
FIG. 8 is a perspective view showing a first embodiment (similar to the one shown in FIG. 3) of a subassembly to be installed in a transparent housing of the present invention shown in FIG. 2, 3, 4, or 6.

The first embodiment of the subassembly shown in FIG. 8 is similar to the one shown in FIG. 3. A lid 101 can be installed on the stopper member 106 or a connecting member 105 (FIG. 1). A gear 120 can be fixed to a rotary member 103 (FIG. 1) and rotate therewith. A connecting piece 131 is fastened to the gear 120 and is fixed with a rotary shaft 127 which is installed with a canopy 128. A housing 129 is provided around the shaft 127 indirectly (with a tube 150 in between) to stabilize the rotation of the shaft. The purpose of the tube 150 is to protect the shaft 127. A plate 130 is positioned around the shaft 127 for supporting some decoration (not shown in the drawings). Another gear 121 is engaged with the gear 120 and fastened with a wheel 124 which has an elongate drive stub 124A. A housing 122 is fixed to the lid 101 and is provided around the wheel 124. Another rotary shaft 132A and two guiding rods 125A and 125B are vertically inserted through the housing 122. A link 123 with a longitudinal slot 123A is fastened to the lower end of the rotary shaft 132A. A figurine (horse) 126A is fastened to the upper part of the rotary shaft 132A. The elongate drive stub 124A is movably located in the longitudinal slot 123A. The rotation of the gear 120 causes the rotation of the gear 121 and the wheel 124, which in turn causes the up and down movement of the link 123, the shaft 132A, the guiding rods 125A and 125B, and the horse 126A.

Figure 9:
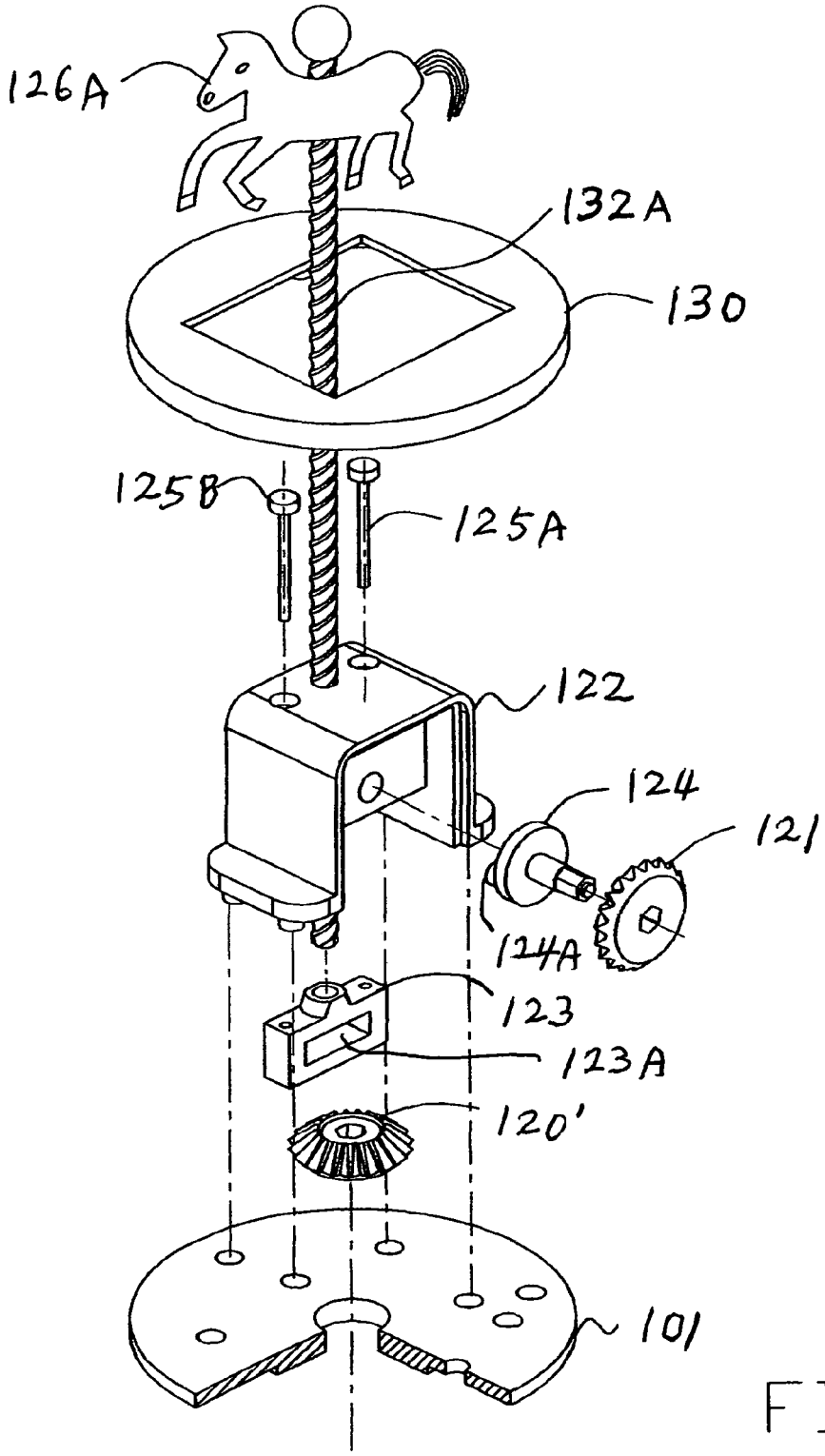
FIG. 9 is a perspective view showing a second embodiment of a subassembly to be installed in a transparent housing of the present invention shown in FIG. 2, 3, or 4.

A second embodiment of the subassembly shown in FIG. 9 is similar to the first embodiment (FIG. 8) of the subassembly. A lid 101 can be installed on the stopper member 106 or a connecting member 105 (FIG. 1). A gear 120' can be fixed to a rotary member 103 (FIG. 1) and rotate therewith. Another gear 121 is engaged with the gear 120' and fastened with a wheel 124 which has an elongate drive stub 124A. A housing 122 is fixed to the lid 101 and is provided around the wheel 124. A shaft 132A and two guiding rods 125A and 125B are inserted through the housing 122. A plate 130 is provided around the shaft 132A for supporting some decoration (not shown in the drawing). A link 123 with a longitudinal slot 123A is fastened to the lower end of the shaft 132A. The elongate drive stud 124A is movably located in the longitudinal slot 123A. The rotation of the gear 120' causes the rotation of the gear 121 and the wheel 124, which in turn causes the up and down movement of the link 123, the shaft 132A, the guiding rods 125A and 125B, and the horse 126A.

Figure 10:
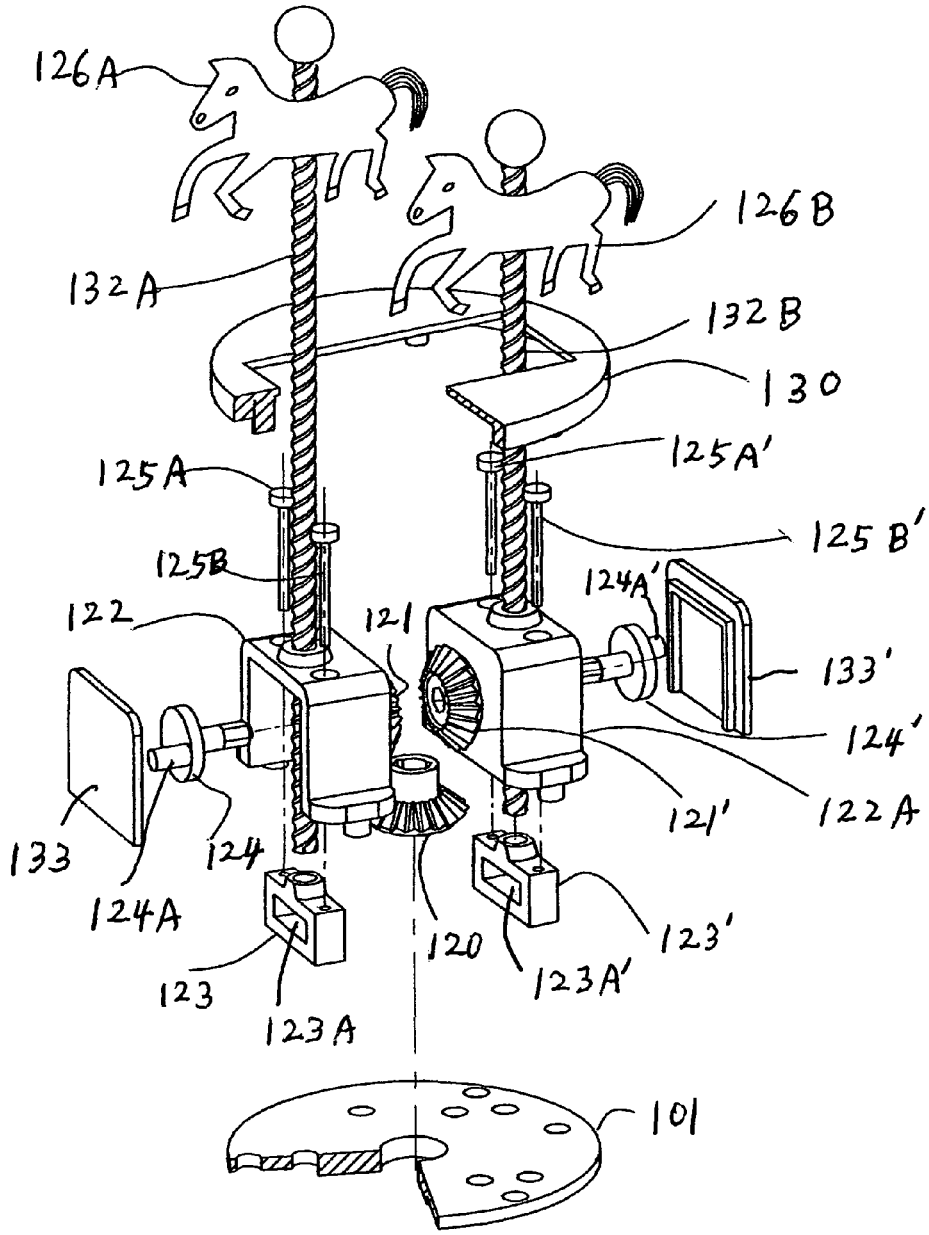
FIG. 10 is a perspective view showing a third embodiment of a subassembly to be installed in a transparent housing of the present invention shown in FIG. 2, 3, or 4.

A third embodiment of the subassembly shown in FIG. 10 is very similar to the second embodiment (FIG. 9) of the subassembly. A lid 101 can be installed on the stopper member 106 or a connecting member 105 (FIG. 1). A gear 120 can be fixed to a rotary member 103 (FIG. 1) and rotate therewith. Two other gears 121 and 121' are engaged with the gear 120 and fastened with wheels 124 and 124', respectively, which have elongate drive stubs 124A and 124A' respectively. Housings 122 and 122A are fixed to the lid 101 and are provided around the wheels 124 and 124' respectively. Rotary shafts 132A and 132B and two pairs of guiding rods 125A, 125B, and 125A', 125B' are inserted through the housings 122 and 122A respectively. A plate 130 is provided around the shafts 132A and 132B for supporting some decoration (not shown in the drawings). Links 123 and 123' with longitudinal slots 123A and 123A' respectively are fastened to the lower end of the rotary shafts 132A and 132B respectively. The elongate drive stubs 124A and 124A' are movably located in the longitudinal slots 123A and 123A' respectively. The rotation of the gear 120 causes the rotation of the gears 121 and 121' and the wheels 124 and 124', which in turn causes the up and down movement of the links 123 and 123', the shafts 132A and 132B, the guiding rods 125A, 125B, 125A' and 125B', and the horses 126A and 126B. Decoration plates 133 and 133' are employed to cover a side of the housings 122 and 122A respectively. In this embodiment, the gear 121' can be omitted and replaced with a shaft (not shown in the drawings) connecting the gear 121 and the wheel 124'. Also, in this embodiment, two housings 122 and 122A can be replaced with a larger housing (not shown in the drawings) to cover the wheels 124 and 124'.

Figure 11:
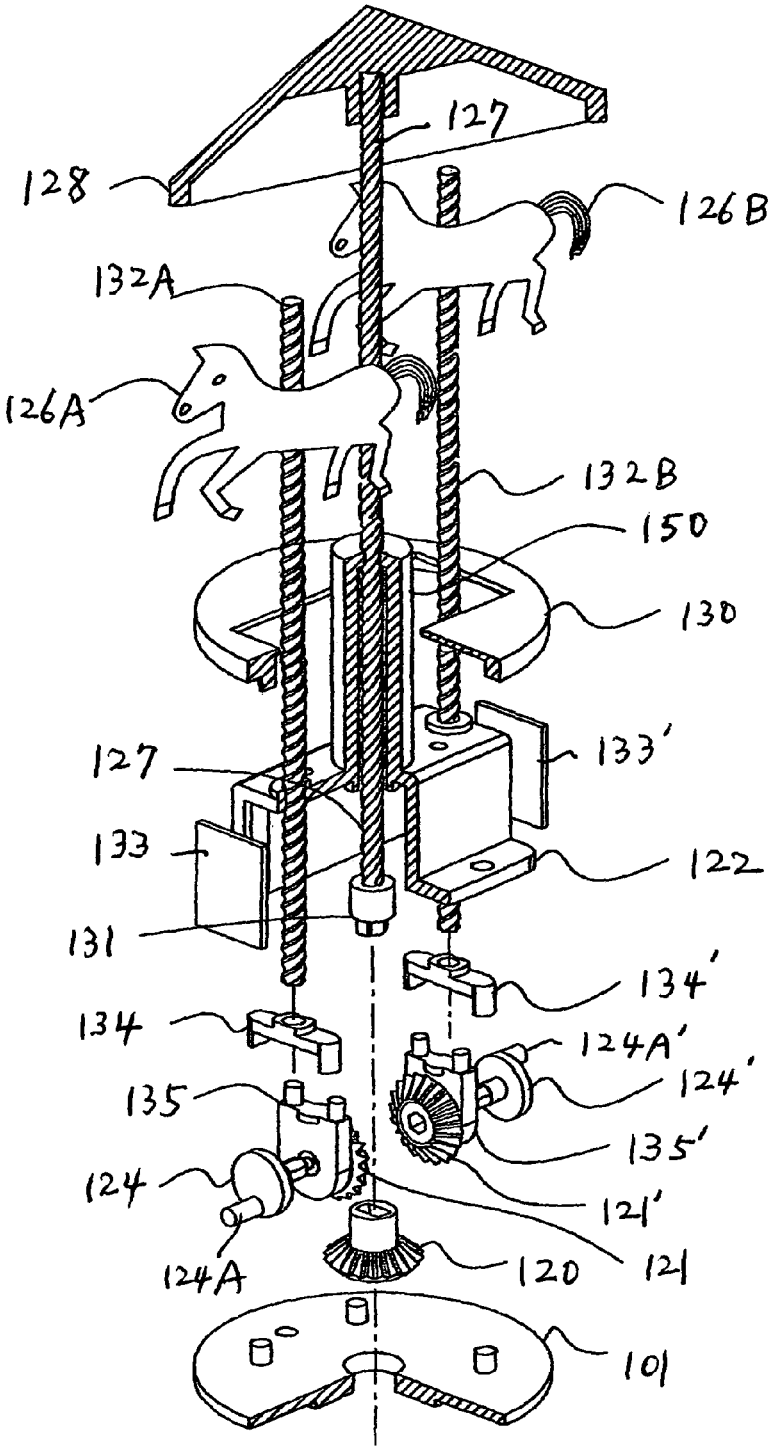
FIG. 11 is a perspective view showing a fourth embodiment of a subassembly to be installed in a transparent housing of the present invention shown in FIG. 2, 3 or 4.

A fourth embodiment of the subassembly shown in FIG. 11 is very similar to the third embodiment (FIG. 10) of the subassembly. This fourth embodiment can differ from the third embodiment merely in that a connecting piece 131 is fixed to the gear 120 and is fastened with a rotary shaft 127 which is protected with a tube 150 and which is fastened with a canopy 128 on its top end. That is to say, all of the elements shown in FIG. 11, except the connecting piece 131, the rotary shaft 127, the tube 150, and the canopy 128, can also be exactly the same as the third embodiment shown in FIG. 10, instead of those shown in FIG. 11. In FIG. 11, one housing 122 is employed to replace the two housings 122 and 122A shown in FIG. 10. Links 134 and 134' are fastened to the lower ends of the shafts 132A and 132B respectively for being moved by the elongate drive stubs 124A and 124A, respectively. Two connecting pieces 135 and 135' are employed for installing the wheels 124, 124' and the gears 121, 121' respectively.

Figure 12:
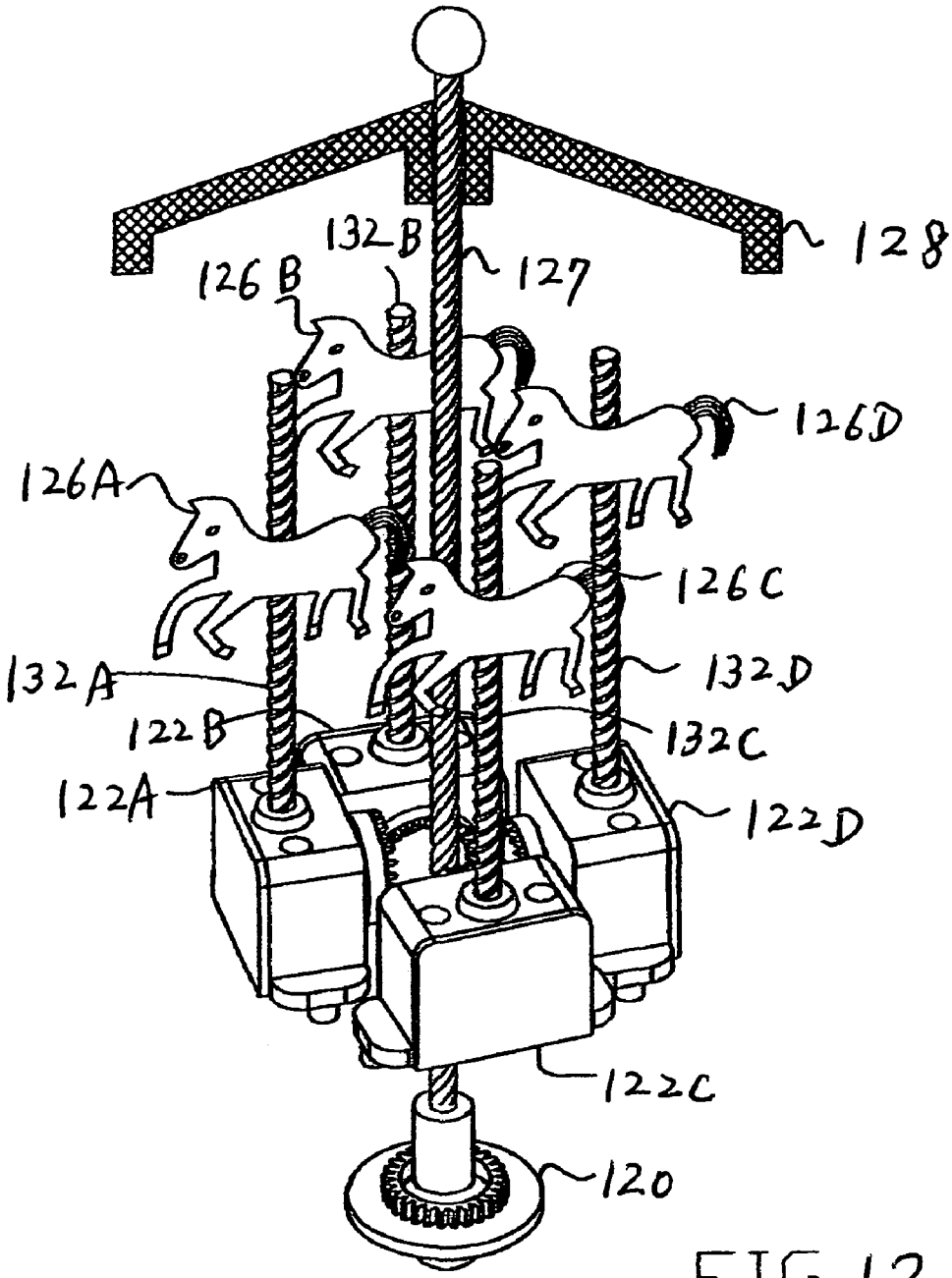
FIG. 12 is a perspective view showing a fifth embodiment of a subassembly to be installed in a transparent housing of the present invention shown in FIG. 2, 3 or 4.

A fifth embodiment of the subassembly shown in FIG. 12 is very similar to the fourth embodiment (FIG. 11) of the subassembly. In FIG. 12, there are four rotary shafts 132A, 132B, 132C, 132D for installing four horses 126A, 126B, 126C, 126D respectively. Four housings 122A, 122B, 122C, 122D are provided around the four rotary shafts 132A, 132B, 132C, 132D respectively. A rotary shaft 127 is installed on a bearing 120 and is fastened with a canopy 128.

Figure 13:
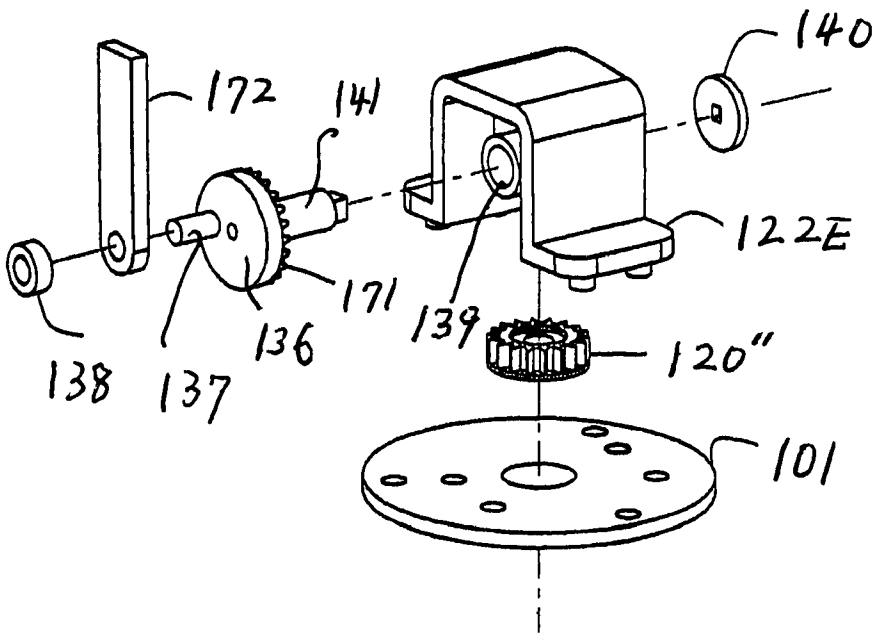
FIG. 13 is a perspective exploded view showing a sixth embodiment of a subassembly to be installed in a transparent housing of the present invention shown in FIG. 2, 3 or 4.
Figure 14:
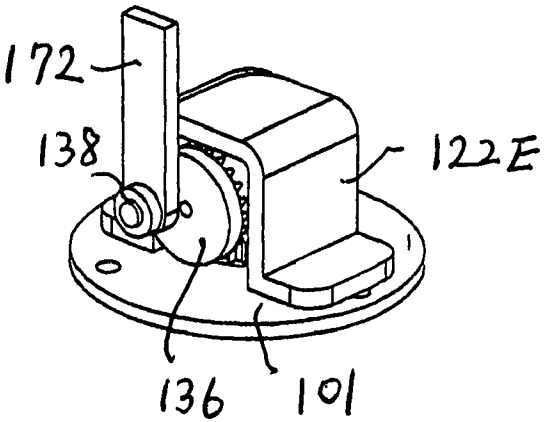
FIG. 14 is a perspective view showing the subassembly of FIG. 13 in assembled condition.

A sixth embodiment of the subassembly is shown in FIGS. 13 and 14. Again, a lid 101 can be installed on the stopper member 106 or a connecting member 105 (FIG. 1). A gear 120" can be fixed to a rotary member 103 (FIG. 1) and rotate therewith. A housing 122E can be fastened to the lid 101. A support tube 139 is provided on the housing 122E, for rotatably supporting a shaft 141. A wheel 136 and a gear 171 (which is engageable with the gear 120") are fixed on the shaft 144. An elongate drive stub 137 is provided on the wheel 136. The stub 137 can be inserted through a hole provided on a rod 172 on which a figurine or a decoration can be fixed. A ring 138 and a fastening piece 140 are fixed to the stub 137 and the end of the shaft 141, respectively. When the gear 120" rotates, the gear 171 and the wheel 136 rotate, thus in turn the stub 137 causes the rod 172 to do reciprocating movement.

Figure 15:
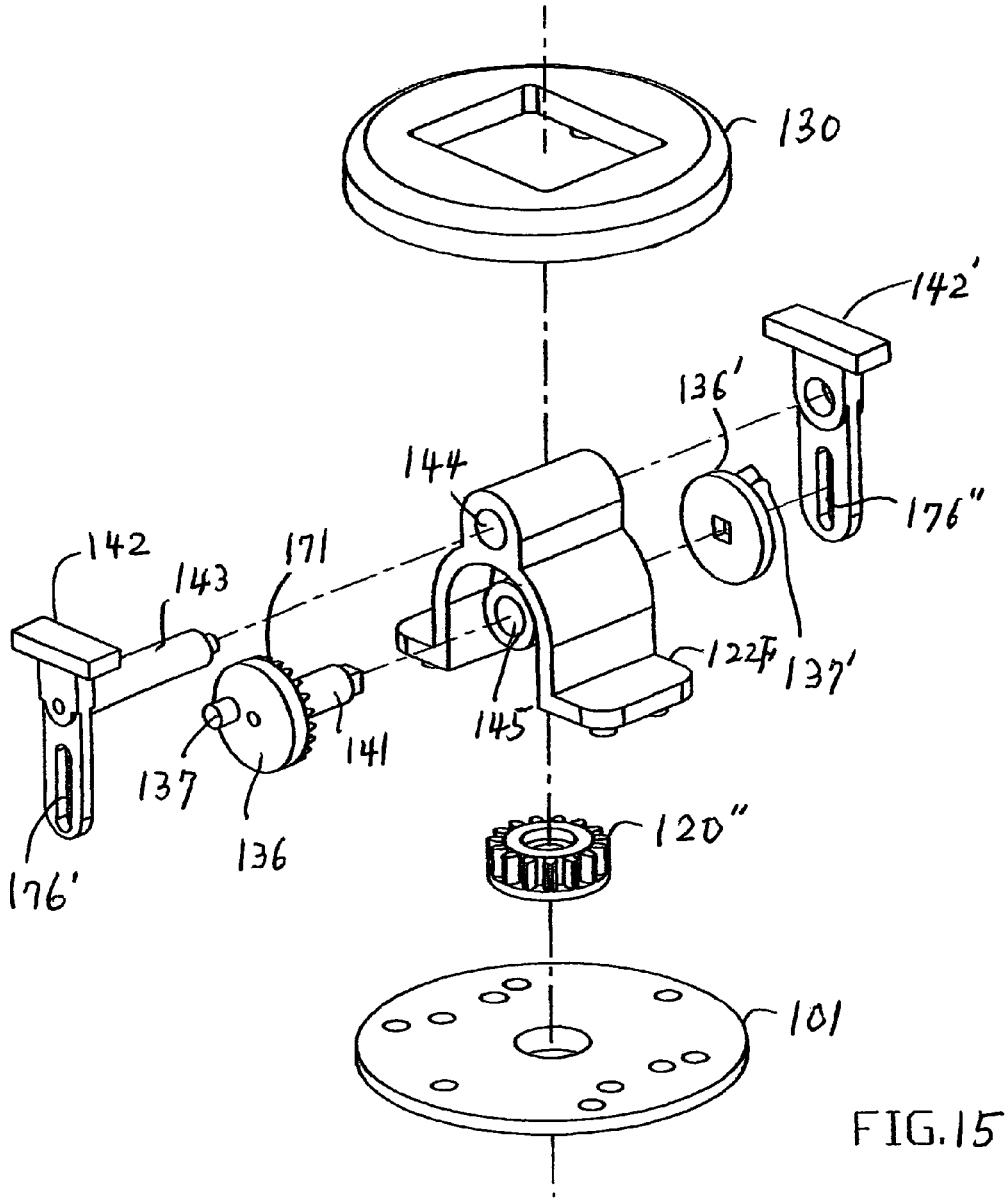
FIG. 15 is a perspective exploded view showing a seventh embodiment of a subassembly to be installed in a transparent housing of the present invention shown in FIG. 2, 3 or 4.

A seventh embodiment of the subassembly is shown in FIG. 15. Again, a lid 101 can be installed on the stopper member 106 or a connecting member 105 (FIG. 1). A gear 120" can be fixed to a rotary member 103 (FIG. 1) and rotate therewith. A housing 122F can be fastened to the lid 101. Two support tubes 144 and 145 can be formed on the housing 122F, for rotatably supporting shafts 141 and 143. A wheel 136 and a gear 171 (which is engageable with the gear 120") are fixed on one side of the shaft 141. Another wheel 136' is fixed in the other side of the shaft 141. The wheels 136 are 136' are provided with elongate drive stubs 137 and 137', respectively. Connecting pieces 142 and 142' are fixed to the two ends of the shaft 141, respectively. Longitudinal slot 176' and 176", in which the elongate drive stubs 137 and 137' can slide respectively, are formed on the connecting pieces 142 and 142', respectively. Figurines or decorations can be positioned on the connecting pieces 142 and 142'. A plate 130 is provided for supporting figurines or decorations. When the gear 120" rotates, the gear 171, the shaft 141, and the wheels 136 and 136' rotates therewith, thus in turn causes the connecting pieces 142 and 142' to do reciprocating movement.

Figure 16:
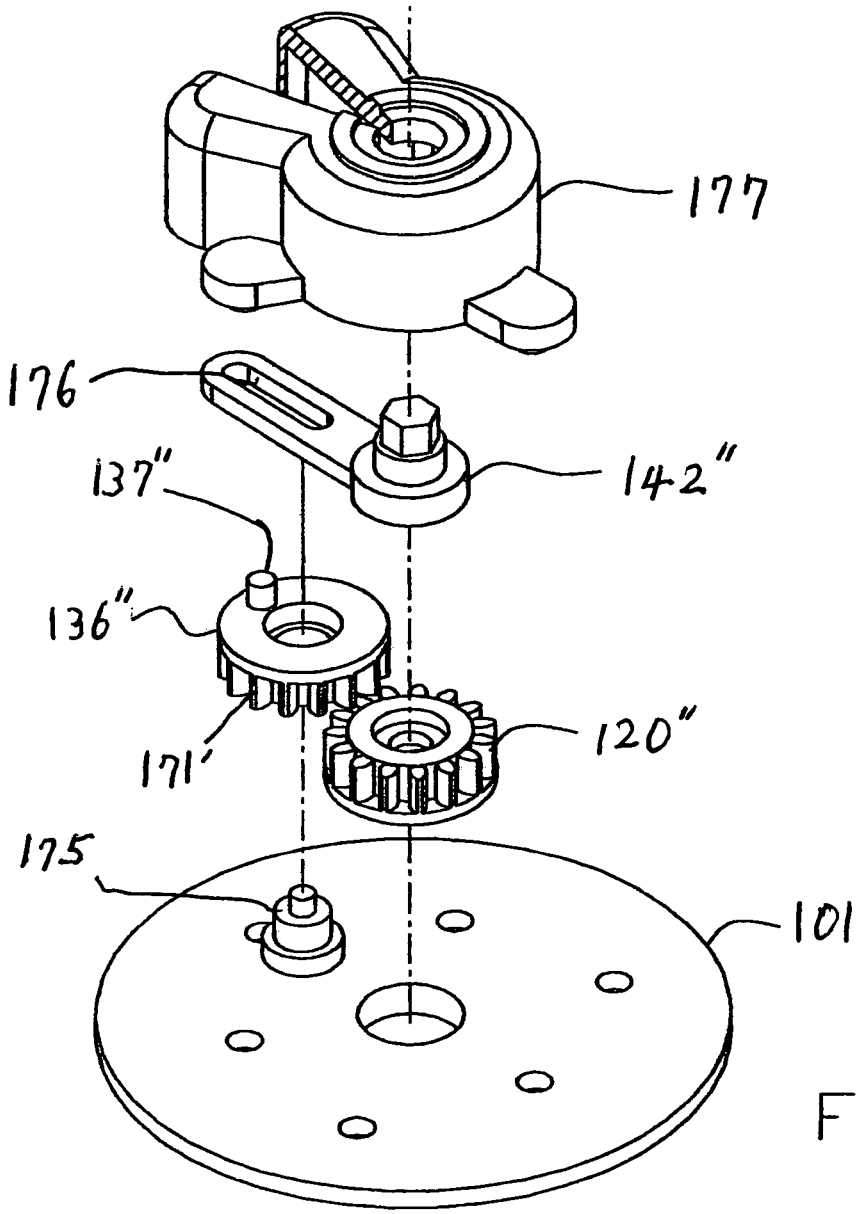
FIG. 16 is a perspective exploded view showing a eighth embodiment of a subassembly to be installed in a transparent housing of the present invention shown in FIG. 2, 3 or 4.

An eighth embodiment of the subassembly is shown in FIG. 16. Again, a lid 101 can be installed on the stopper member 106 or a connecting member 105 (FIG. 1). A gear 120" can be fixed to a rotary member 103 (FIG. 1) and rotate therewith. A rod 175 is fixed on the lid 101. A gear 171' and a wheel 136" having a through hole in the central portion thereof respectively are rotatably installed on the rod 175. The gear 171' is engageable with the gear 120". An elongate drive stub 137" is formed on the wheel 136". A connecting piece 142", on which a figurine or decoration can be fixed, is rotatably installed on top of the gear 120". The connecting piece 142" is formed with a longitudinal slot 176 in which the elongate drive stub 137" can slide. A lid 177 is positioned over connecting piece 142" for confining the movement of the connecting piece 142". When the gear 120" rotates, the gear 171', and the wheel 136" rotate, thus in turn causes a reciprocative movement of the connecting piece 142".

Figure 17:
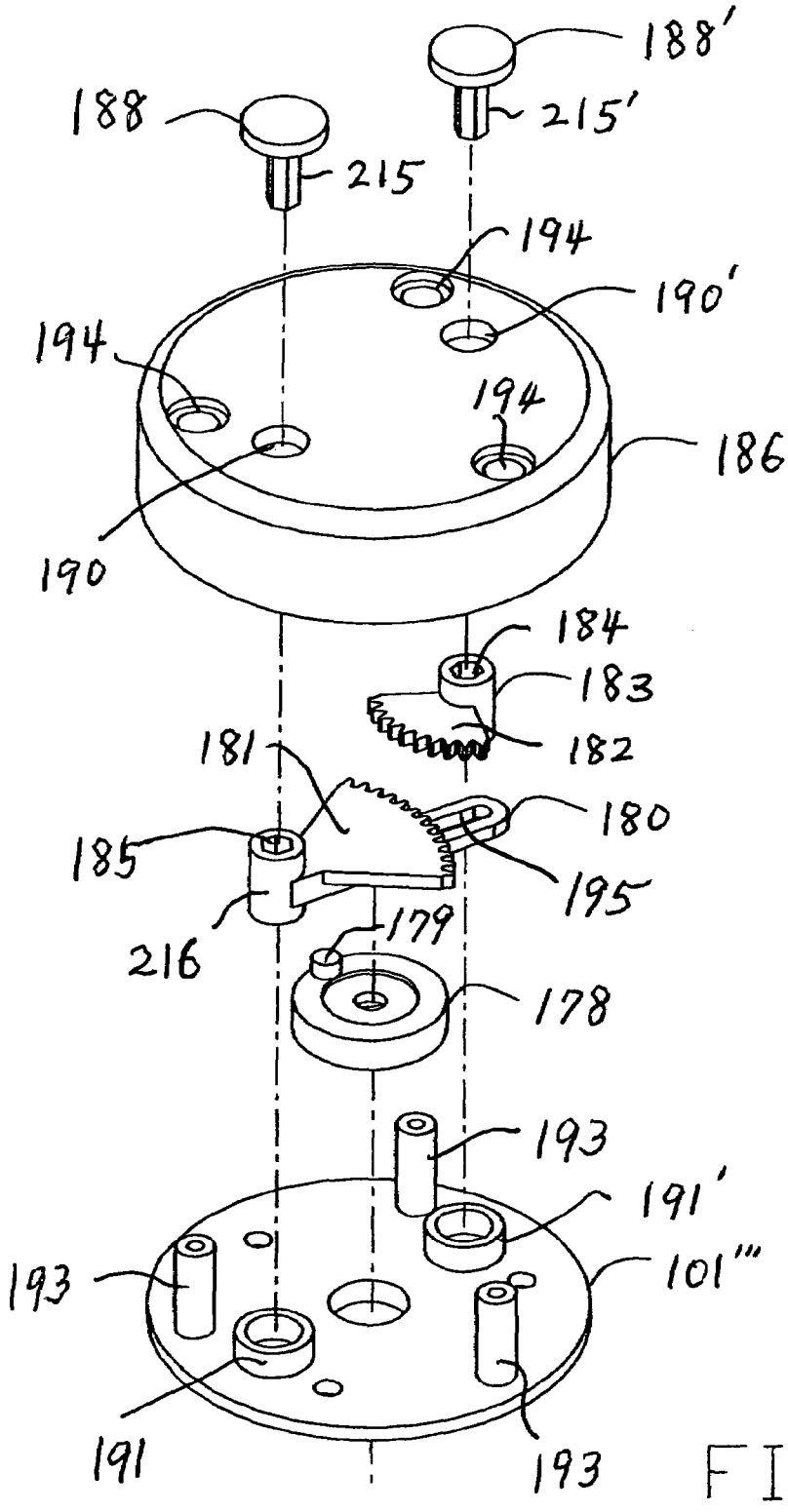
FIG. 17 is a perspective exploded view showing a ninth embodiment of a subassembly to be installed in a transparent housing of the present invention shown in FIG. 2, 3 or 4.

A ninth embodiment of the subassembly is shown in FIG. 17. Again, a lid 101'" can be installed on the stopper member 106 or a connecting member 105 (FIG. 1). A wheel 178 having an elongate drive stub 179 is installed on a rotary member 103 (FIG. 1) and rotates therewith. A plurality of tubes 193, 191, and 191' are provided on the lid 101'". A moving piece 180 having a longitudinal slot 195 is fixed with a tube 216 having a hole 185 and a gear plate 181. A tube 183 having a hole 184 is fixed with a gear plate 182. The elongate drive stub 179 is located in the longitudinal slot 195 and slideable therein when the wheel 178 rotates. A cover plate 186 is positioned on the lid 101'" and is provided with holes 194, 190 and 190'. The upper ends of the tubes 193 are fastened at the holes 194 of the cover plate 186. Two supports 188 and 188' for supporting figurines or decorations thereon are fixed with rods 215 and 215' respectively. The rods 215 and 215' are inserted through the holes 190 and 190' respectively, and fastened in the holes 185 and 184 of the tubes 216 and 183 respectively. The tubes 216 and 183 are rotatably installed in the tubes 191 and 191' respectively. When the wheel 178 rotates, the elongate drive stub 179 drives the moving piece 180, the tube 216 and the gear plate 181 which engages with the gear plate 182 to reciprocate. Thus this causes the gear plate 182, the tube 183, the rods 215 and 215', and the supports 188 and 188' to reciprocate. In this embodiment, the gear plate 182, the tube 183, the support 188' and the rod 215 can be omitted. That is to say, only one support 188 can be used to support a figurine or decoration.

Figure 18:
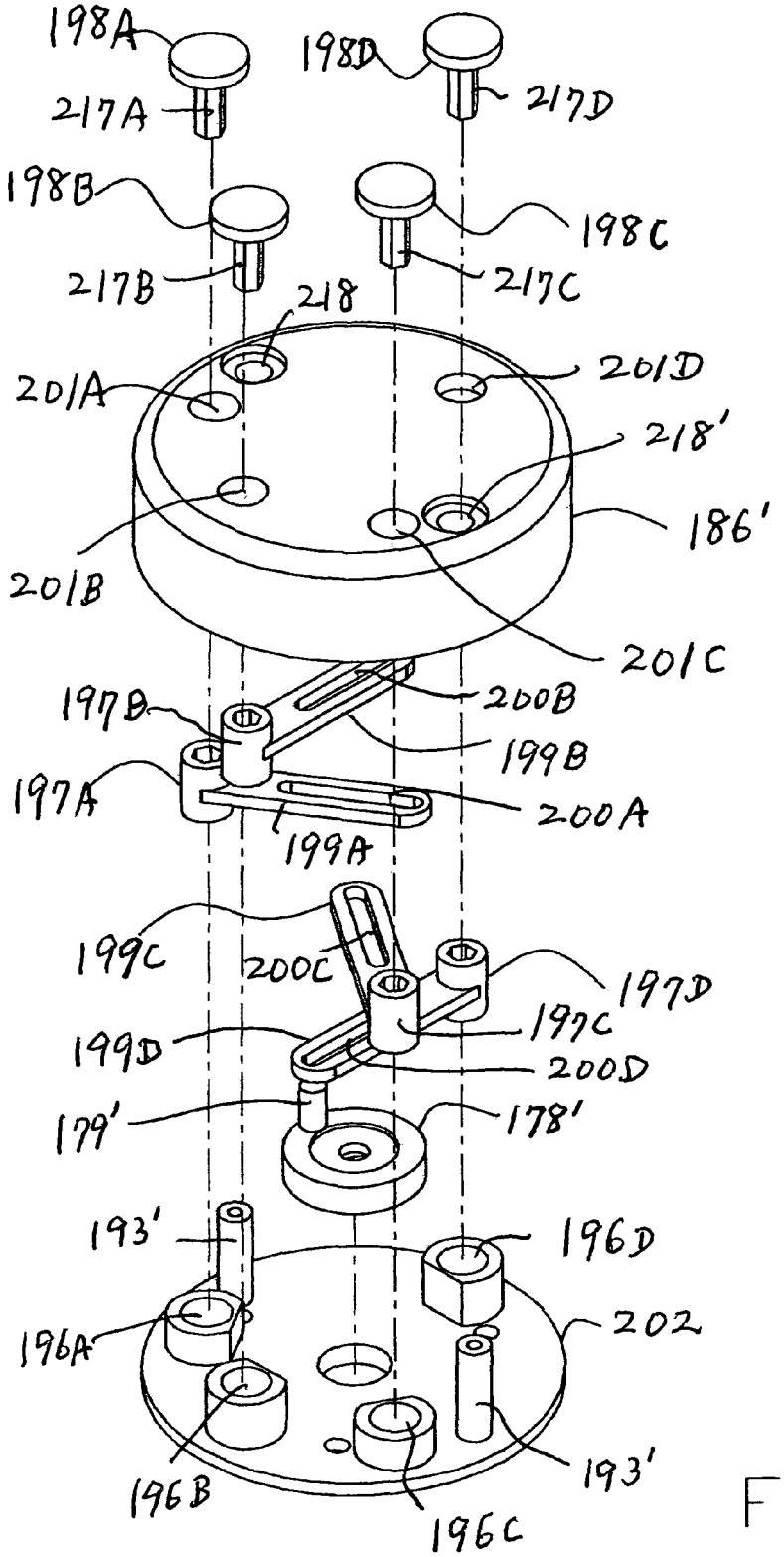
FIG. 18 is a perspective exploded view showing a tenth embodiment of a subassembly to be installed in a transparent housing of the present invention shown in FIG. 2, 3 or 4.

A tenth embodiment of the subassembly is shown in FIG. 18. Again, a lid 202 can be installed on the support member 106 or a connecting member 105 (FIG. 1). A wheel 178' having an elongate drive stub 179'0 is rotatably installed on a rotary member 103 (FIG. 1) and rotates therewith. A plurality of tubes 193', 196A, 196B, 196C, and 196D are provided on the lid. Rotary tubes 197A, 197B, 197C, and 197D are rotatably installed in the tubes 196A, 196B, 196C, and 196D respectively, and fastened with connecting pieces 199A, 199B, 199C, and 199D respectively, which are provided with longitudinal slots 200A, 200B, 200C, and 200D respectively. The elongate drive stub 179' can be inserted into the longitudinal slots 200A, 200B, 200C, and 200D and slide therein when the wheel 178' rotates. A cover plate 186' is positioned on the lid 202 and is provided with holes 218, 218', 201A, 201B, 201C, and 201D. Supports 198A, 198B, 198C, and 198D for supporting figurines or decorations thereon are fastened with rods 217A, 217B, 217C, and 217D respectively, which insert through the holes 201A, 201B, 201C, and 201D on the cover plate 186' respectively, and installed in the rotary tubes 197A, 197B, 197C, and 197D respectively. When the wheel 178' rotates, the elongate drive stub 179' drives the connecting pieces 199A, 199B, 199C, and 199D to reciprocate, and the rotary tubes 197A, 197B, 197C, and 197D to rotate, respectively. Thus the rods 217A, 217B, 217C, and 217D, and supports 198A, 198B, 198C, and 198D rotate respectively. The cover plate 186' is fastened to the upper ends of the tubes 193' at the holes 218 and 218'. The movement of the connecting pieces 199A, 199B, 199C, and 199D does not interfere with each other because they are on different heights (levels).

Figure 19:
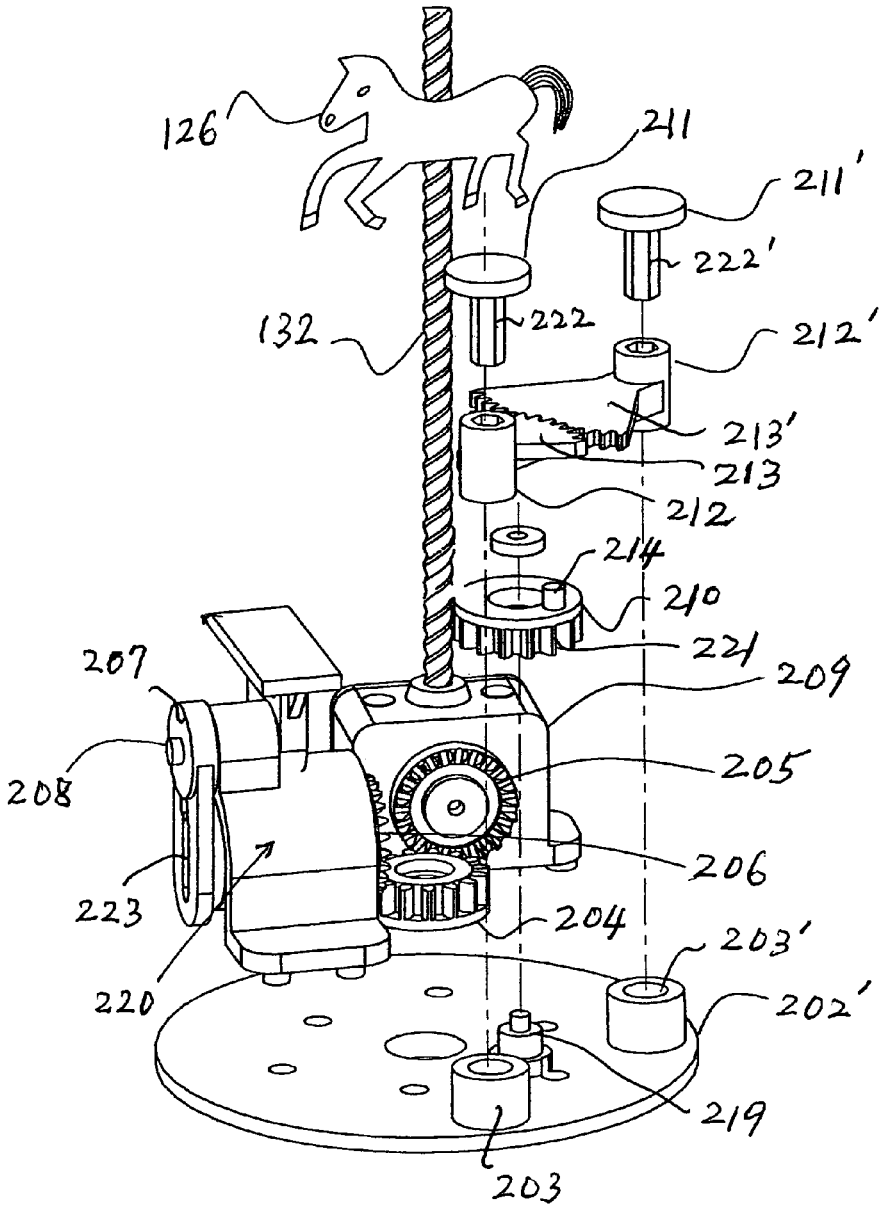
FIG. 19 is a perspective exploded view showing a eleventh embodiment of a subassembly to be installed in a transparent housing of the present invention shown in FIG. 2, 3 or 4.

An eleventh embodiment of the subassembly is shown in FIG. 19. Again, a lid 202' can be installed on the support member 106 or a connecting member 105 (FIG. 1). A rod 219 and tubes 203 and 203' are provided on the lid 202'. A gear 221 and a wheel 210 having an elongate drive stub 214 are rotatably provided on the rod 219. A gear 204 engageable with the gear 221 can be installed on a rotary member 103 (FIG. 1) and rotate therewith. A rotary tube 212 is fixed with a gear plate 213 which is engageable with a gear plate 213' fixed with a rotary tube 212'. A moving piece and a longitudinal slot (in which the elongate drive stub 214 slides) similar to the moving piece 180 and the longitudinal slot 195 shown in FIG. 17 are provided under the gear plate 213 and fixed to the rotary tube 212. Supports 211 and 211' for supporting figurines or decorations having rods 222 and 222' are fastened to the rotary tubes 212 and 212' respectively, with the rods 222 and 222' inserted into the tubes 212 and 212' respectively. When the wheel 210 rotates, the stub 214 drives the tubes 212 and 212', the gear plates 213, and 213', and the supports 211, and 211' to move. A housing 209 is fastened to the lid 202', with a rotary shaft 132 provided therethrough. A gear 205 (engageable with the gear 204) and a wheel with an elongate drive stub (not shown in the drawing) (similar to the gear 121 and wheel 124 with an elongate drive stub 124A in FIG. 8) can be installed on the housing 209. A link with a longitudinal slot (not shown in the drawing) (similar to the link 123 with the longitudinal slot 123A in FIG. 8) can be fixed to the lower end of the shaft 125. When the wheel 205 rotates, the shaft 132 and the horse 126 move upwardly and downwardly. Another housing 220 is fastened to the lid 202' with a gear 206 rotatably installed on it. The gear 206 is engageable with the gear 204. The inside structure of the housing 220 is similar to that shown in FIGS. 13 and 14 (i.e., a wheel with an elongate drive stub not shown in the drawing is fastened to the gear 206). A connecting piece 207 having a longitudinal slot 223 is rotatably installed on a shaft 208. The elongate drive stub in the housing 220 is located in the longitudinal slot 223 and can slide thereon. A figurine or a decoration can be fastened to the connecting piece 207. When the gear 206 rotates, the wheel rotates, the stub drives the connecting piece 207 to reciprocate.

The foregoing description is provided for illustrative purposes only and should not be construed as any way limiting this invention, the scope of which is defined solely by the appended claims.

I claim:

1. A decorative display comprising:

a) a support base having at least one support extending therefrom;

b) a decorative base member separate from the support base and located on the support base;

c) a transparent housing located in the decorative base member and having a bottom portion defining a bottom portion opening;

d) a stopper member fitted with the bottom portion of the transparent housing so as to cover the bottom portion opening; wherein the stopper member has no hole on its center portion;

e) at least one first magnet located on top of the stopper member:

f) at least one second magnet located below the stopper member;

g) a power source for rotating the second magnet;

h) a mechanism for transmitting the power output of the power source to at least one decoration for imparting a desired movement thereto;

i) a first rotary member that supports the first magnet;

j) a second rotary member that supports the second magnet;

k) a connecting member fastened to the stopper member and provided for rotatably accommodating the first rotary member; and l) a lid installed on the connecting member for preventing the first rotary member from falling off and on which the decoration or mechanism is installed;

wherein the mechanism comprises a first gear fastened to the first rotary member, at least one second gear engageable with the first gear and fastened with at least one wheel having an elongate drive stub, at least one housing fixed to the lid and positioned around the wheel, at least one shaft and at least one guiding rod inserted through the housing, and a link with a longitudinal slot fastened to the lower end of the shaft, wherein the elongate drive stub is movably located in the longitudinal slot, the rotation of the first gear causes the rotation of the second gear and the wheel, which in turn causes up and down movement of the link, the shaft and the guide rod.

2. A decorative display comprising:

a) a support base having at least one support extending therefrom;

b) a decorative base member separate from the support base and located on the support base;

c) a transparent housing located in the decorative base member and having a bottom portion defining a bottom portion opening;

d) a stopper member fitted with the bottom portion of the transparent housing so as to cover the bottom portion opening;

e) at least one first magnet located on top of the stopper member:

f) at least one second magnet located below the stopper member; and g) a power source for rotating the second magnet;

wherein at least one gear is operatively connected to the power source for transmitting the movement of the power source to the second magnet; wherein at least one vane is fastened to the first magnet for agitating some particles in the transparent housing; wherein a first lid is installed on the stopper member for installing the vane and the first magnet; wherein a second lid is provided to prevent the vane and the first magnet from falling off; and wherein when the power source rotates, the gear, the magnets, and the vane rotate to agitate particles in the transparent housing.

3. A decorative display comprising:

a) a support base having at least one support extending therefrom;

b) a decorative base member separate from the support base and located on the support base;

c) a transparent housing located in the decorative base member and having a bottom portion defining a bottom portion opening;

d) a stopper member fitted with the bottom portion of the transparent housing so as to cover the bottom portion opening;

e) at least one first magnet located on top of the stopper member:

f) at least one second magnet located below the stopper member; and g) a power source for rotating the second magnet;

wherein a first lid is provided on the stopper member, the first lid has at least one opening, the first magnet and a rotary member for agitating particles in the transparent housing are positioned in the first lid, a second lid covers the first lid and is provided with an opening so that the particles agitated by the rotary member can exit.

4. A decorative display comprising:

a) a support base having at least one support extending therefrom;

b) a decorative base member separate from the support base and located on the support base;

c) a transparent housing located in the decorative base member and having a bottom portion defining a bottom portion opening;

d) a stopper member fitted with the bottom portion of the transparent housing so as to cover the bottom portion opening;

e) at least one first magnet located on top of the stopper member:

f) at least one second magnet located below the stopper member; and g) a power source for rotating the second magnet;

wherein a first rotary member, a second rotary member, a connecting member, and a lid are further provided; wherein a first rotary coupler is operatively connected to the power source; the second rotary coupler, a rotary piece, and the second rotary member are operatively connected to the first rotary coupler; wherein a socket member fastened to the stopper member is provided for accommodating and stabilizing the second rotary member; and wherein the stopper member is provided with a first recessed portion for accommodating the first rotary member and the connecting member, and a second recessed portion for accommodating the second rotary member.

5. The decorative display of claim 4, wherein a first gear is fastened to the first rotary member; a second and a third gear are located engageably with the first gear; a rotary cover having teeth is provided so that the teeth of the rotary cover can engage the second and the third gears.

6. The decorative display of claim 5, further comprising a fourth gear operatively fastened to the first gear.

* * * * *